US008763926B2

(12) United States Patent
Powell et al.

(10) Patent No.: US 8,763,926 B2
(45) Date of Patent: Jul. 1, 2014

(54) APPARATUS FOR PROVIDING OIL LAMP LIGHTING EFFECTS

(75) Inventors: Gary Powell, Palmdale, CA (US); Joe M. Rohde, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 365 days.

(21) Appl. No.: 13/301,468

(22) Filed: Nov. 21, 2011

(65) Prior Publication Data

US 2013/0126633 A1 May 23, 2013

(51) Int. Cl.

| | |
|---|---|
| ***F21S 8/00*** | (2006.01) |
| ***B05B 17/00*** | (2006.01) |
| ***B05B 17/08*** | (2006.01) |

(52) U.S. Cl.

CPC ..... *B05B 17/00* (2013.01); *B05B 17/08* (2013.01)

USPC ..... 239/18; 239/16; 239/20; 239/23; 239/211; 239/289; 362/96

(58) Field of Classification Search

USPC ..... 239/16–18, 20, 22, 23, 211, 289; 362/96

See application file for complete search history.

(56) References Cited

U.S. PATENT DOCUMENTS

| | | | | |
|---|---|---|---|---|
| 1,549,204 | A * | 8/1925 | Merigold | 239/20 |
| 2,976,450 | A | 3/1961 | Benoliel | |
| 5,775,586 | A * | 7/1998 | Hamilton-Bruzzi et al. | 239/20 |
| 5,989,128 | A | 11/1999 | Baker et al. | |
| 6,196,471 | B1 | 3/2001 | Ruthenberg | |
| 6,607,144 | B1 * | 8/2003 | Yen | 239/211 |
| 7,303,300 | B2 | 12/2007 | Dowling et al. | |
| 7,886,992 | B2 | 2/2011 | Wiseman et al. | |
| 2004/0262417 | A1 | 12/2004 | Proch | |
| 2007/0053174 | A1 | 3/2007 | Lin | |
| 2009/0251669 | A1 | 10/2009 | Power | |
| 2010/0276508 | A1 | 11/2010 | Davies | |
| 2011/0062250 | A1 | 3/2011 | Betz et al. | |

FOREIGN PATENT DOCUMENTS

| | | | |
|---|---|---|---|
| CN | 2754912 | Y | 2/2006 |
| CN | 2838765 | Y | 11/2006 |
| CN | 201081219 | Y | 7/2008 |
| CN | 201205535 | Y | 3/2009 |

(Continued)

OTHER PUBLICATIONS

L.E.D. Showerhead Light, http://www.houseofrave.com/led-showerhead.html; May 5, 2011.

*Primary Examiner* — Steven J Ganey
(74) *Attorney, Agent, or Firm* — Marsh Fischmann & Breyfogle; Kent A. Lembke

(57) ABSTRACT

An oil lamp-type apparatus or a Kukui pot candle device for achieving the illumination and the appearance of an ignited oil lamp. This is achieved by illuminating water flowing upward (e.g., substantially vertically to provide a flame-shaped element or small fountain of water above the pool surface) using a light source directing its light output upward through the water. The flame-shaped element has kinetic and dynamic movement similar to a flame on an oil lamp or candle wick due to the combination of the water flowing upward and the water falling nearly straight down back into a pool about the water outlet. Further, the effect is achieve by only illuminating the liquid in the flame-shaped element with the vertically upward-direct light stream and not by shining light from the side, from above, or even from an adjacent location.

28 Claims, 7 Drawing Sheets

(56) References Cited

FOREIGN PATENT DOCUMENTS

| | | | |
|---|---|---|---|
| CN | 101476634 | A | 7/2009 |
| DE | 202005011205 | U1 | 9/2005 |
| JP | 6274116 | A | 9/1994 |
| JP | 2005080913 | A | 3/2005 |
| NL | 1035315 | C1 | 8/2008 |

* cited by examiner

APPARATUS FOR PROVIDING OIL LAMP LIGHTING EFFECTS

BACKGROUND

1. Field of the Description

The present description relates, in general, to oil lamps and similar devices for providing illumination of spaces, and, more particularly, to an apparatus for providing illumination similar to that of a oil lamp, e.g., a Kukui pot candle, without the need for an actual flame or even for a wick and fuel that both have to be replaced or maintained.

2. Relevant Background

There are numerous devices and methods for providing lighting in buildings and for illuminating an outdoor space. Often, it is desirable, not only to provide lighting but to do so in a way that provides particular quality of light to achieve a particular illumination effect. For example, it may be useful to provide lower amounts of lighting in a room to set a desired mood. Likewise, it may be useful in an outdoor setting such as along a path or around a pool to provide some illumination for safety and to establish a relaxed and inviting atmosphere. Lights that are too bright may be undesirable in such applications. The lighting effect may also be enhanced with lighting that flickers or varies such as achieved with a flame that causes light levels to vary and creates light patterns and shadows that move in a relaxing and interesting manner.

In this regard, oil lamps have been used as a form of lighting for thousands of years for household lighting, for outdoor lighting, and for votive and other purposes. An oil lamp typically is a man-made object used to continuously produce light for a period of time using an oil or oil-based fuel source. Typically, the body of the lamp would be shaped as a pot or bowl to provide a fuel chamber or basin for receiving a volume of oil or similar liquid fuel. An opening or nozzle was provided in the body of the lamp to provide access to the fuel, and a wick was placed over or in this opening so as to extend into and out of the fuel chamber.

When lit, the wick would typically provide a flame with a height typically of less than one inch, and the flame would provide relatively low levels of illumination and would flicker and appear to float, in some oil lamps, on the surface of the pool of liquid fuel or oil. The size and shape of oil lamps varies widely as does the type of oil used as the fuel source. In one common example, candlenut or Kukui nut oil is used as the fuel, and it is, or was, common in Hawaii and other islands for oil lamps called Kukui pots or Kukui pot candles to be used to provide illumination particularly in outdoor settings.

There are many settings where the lighting effect provided by oil lamps such as Kukui pot candles is desired. However, it is desirable to achieve this lighting effect without the safety concerns associated with open flames and oil-based fuel sources and also without the need to refill the oil lamps and perform other maintenance such as replacing wicks. Hence, there remains a need for an apparatus that effectively and realistically provides the illumination or lighting effect of an oil lamp without the need for oil (a liquid fuel) or for a flame that may be thought of as a flameless and oil-free oil lamp.

SUMMARY

The present invention addresses the above problems by providing a lighting assembly or apparatus that effectively simulates an operating oil lamp such as by creating an illumination effect similar to a lit Kukui pot candle. To this end, a bowl or other receptacle for receiving a liquid such as water is provided, and a nozzle extends vertically upward within this bowl. Pressurized water is fed to the nozzle such that a volume of water travels straight from a surface of water in the bowl. A light source, such as an amber light emitting diode (LED) is positioned to direct light upward through the nozzle such that the pressurized water discharged from the nozzle is illuminated.

To make the lighting effect more genuine or realistic, an overflow inlet or drain line inlet is positioned a small distance above the nozzle outlet. This causes the surface of the liquid pool in the bowl to be above the nozzle outlet such that the ejected water has to travel through a portion of this retained water, and this causes the ejected water to push up some of the retained water and disrupts its flow such that it takes on a desirable shape (e.g., a flame shaped fountain of water when the upward moving water is combined with the water collapsing downward upon itself).

More particularly, an apparatus is provided for creating an oil lamp lighting effect. The apparatus includes a receptacle with an inner surface defining a basin for containing a volume of liquid. The apparatus further includes a nozzle extending into the receptacle a height above the inner surface and also includes a liquid input manifold for directing pressurized liquid to an inlet of the nozzle. The nozzle has an outlet ejecting the pressurized liquid received at the nozzle inlet vertically upward. Additionally, the apparatus includes a light source operable to output light into the liquid input manifold, whereby the output light illuminates the pressurized liquid received at the inlet and ejected out of the nozzle outlet.

In some embodiments, the pressurized liquid is ejected vertically upward at an angle that is substantially orthogonal to a horizontal plane (e.g., at an angle of 89 to 91 degrees or the like to cause the ejected water to collapse upon itself instead of being sprayed off to one side or the other). The apparatus may include a drain line in the receptacle with an inlet at a height above a base of the inner surface for receiving the liquid in the basin having a depth greater than the inlet height. In such cases, the nozzle outlet may be at a height that is less than the height of the inlet such that the pressurized liquid ejected out of the nozzle travels through a portion of the liquid in the basin. For example, the inlet height may be greater than the nozzle outlet height by at least 0.2 inches, and the pressurized liquid ejected out of the nozzle outlet travels to a height above the inlet height that may be at least about 0.5 inches.

In some cases, the light source is connected to a port of the liquid input manifold and directs the output light vertically upward through the liquid input manifold and a fluid passageway of the nozzle. The light source may be a light emitting diode and a heat sink may be provided for supporting the light emitting diode and for conducting heat away from the light emitting diode. The light source may further include a lens between the light emitting diode and the liquid input manifold, with the lens being fabricated from a heat resistive material and focusing the output light into an inlet of the nozzle.

In some embodiments, the liquid input manifold includes two inlets for receiving the pressurized liquid. In such embodiments, the apparatus further includes a low pressure line connected to one of the two inlets providing a first stream of liquid at a first pressure and a high pressure line connected to a different one of the two inlets selectively providing a second stream of liquid at a second pressure greater than the first pressure.

DETAILED DESCRIPTION OF THE PREFERRED EMBODIMENTS

Figure 1:
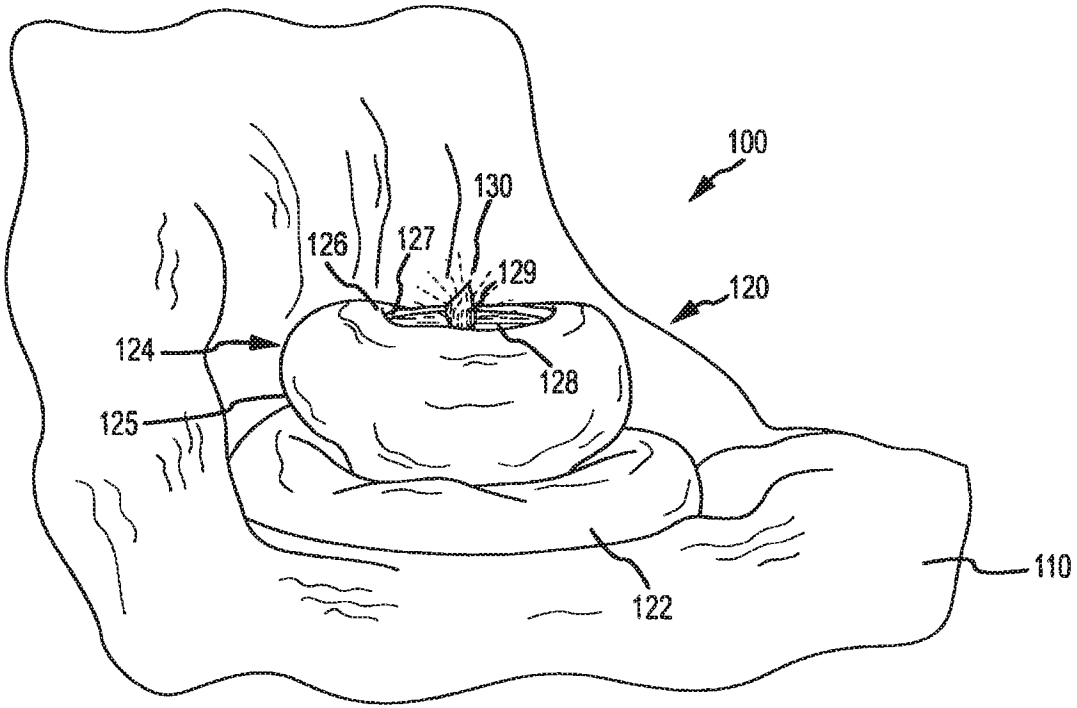
FIG. 1 is a side perspective view of an apparatus of the present invention operating to provide oil lamp-type illumination (e.g., appear to be a burning Kukui pot candle)

Briefly, an oil lamp-type apparatus or a Kukui pot candle device is provided that achieves illumination and the appearance of an ignited or lit oil lamp. This is generally achieved by illuminating water flowing upward (e.g., substantially vertically to provide a flame-shaped element or small fountain of water above the pool surface) using a light source configured to direct its light output upward through the water. Significantly, the flame-shaped element has kinetic and dynamic movement similar to a flame on an oil lamp or candle wick due to the combination of the water flowing upward and the water falling nearly straight down back into a pool about the water outlet. Further, the effect is achieved by only illuminating the liquid in the flame-shaped element with the vertically upward-direct light stream and not by shining light from the side, from above, or even from an adjacent location, which undesirably would cause the water in the pool to also be illuminated.

As background, the inventors were tasked with creating an effect similar to that provided by a Kukui pot candle used in Hawaii. In the candles, a volcanic rock was carved into the shape of a bowl and Kukui nut oil was added to the bowl along with wick. When ignited, the Kukui pot candle was used for night time illumination. In contrast, the inventors developed a device or apparatus that provides a very similar illumination or lighting effect as a Kukui pot candle that uses water (or other non-flammable liquid) and a light source (e.g., an light emitting diode (LED) and lens). There are no consumables like Kukui nut oil or other fuel required for this lighting effect.

In one prototype, the lighting apparatus uses a standard plumbing tee or a plumbing cross that has water introduced into one port of the tee or cross and an LED or other light source is used to introduce light into another port of the tee or cross. The illuminated water then exits a third port of the tee or cross into a bowl or pot that is filled with a volume of water (e.g., a small pool of water) such that the water is distributed upward from the surface of the pool to provide an illuminated, flame-shaped element above the pool surface. In this way, the apparatus gives the illusion of a flame flickering on a body of water.

In some embodiments, the flow of water may be continuous while the flame is "ignited" or lit with one inlet of pressurized water. In other embodiments, the reason a tee or cross may be used is to provide water at two different pressures (a lower pressure to provide a base flame element and a selectively provided higher pressure to cause the flame to increase in size or to jump dynamically). The water at a higher pressure is isolated via a solenoid or other control valve. When the solenoid valve is triggered (such as by a remote controller or by a user-operated controller for interactivity), the faux flame shoots much higher (but, note, the entire liquid of the flame may not stay illuminated through the full stream at the higher pressure).

FIG. 1 illustrates a perspective view of an operating illumination or lighting assembly 100 of the present invention. As shown, the assembly 100 includes a support structure 110 that may take the form of a decorative rock (as shown) or other feature of the environment in which the assembly 100 is provided. The assembly 100 further includes a Kukui pot candle device 120 (but could be nearly any oil lamp-type design) with a base 122 attached to a surface of the support structure 110, e.g., about the periphery of a hole or opening in the structure 110 such that portions of the device 120 may be hidden from view.

The device 120 further includes a bowl or pot 124 attached to and supported by the base 122. The bowl 124 includes a sidewall 125 extending in a generally circular manner to define a basin or recessed surface 127 for receiving a volume of liquid. The upper surface 128 of the liquid (e.g., water or another liquid that is transmissive of light) is retained, in this embodiment 100, below a rim or upper edge 126 of the bowl sidewall 125. This may be achieved by drain or return lines that have their inlets a distance below the upper edge 126 such that the surface 128 is at or just above the height of such drain/return line inlets.

Significantly, the operating device 120 includes an illuminated flame element or faux flame 129 extending upward (e.g., at an angle that may be substantially perpendicular to the horizontal plane of the surface 128 such as an angle with a range of 85 to 95 degrees with 89 to 91 degrees being preferred and 90 degrees being more preferred) a distance such as 0.5 to 2 inches or the like. The light provided by the flame element 129 is shown at 130 as emanating from nearly all surface or portions of the flame element 129. The flame element 129 appears to flicker with light 130 due to the upward flowing central portion of the water combined with the volume of water falling down to surface 128. The body of flame element 129 is, thus, continuously changing in shape and size similar to a true flame of a candle or oil lamp.

Figure 2:
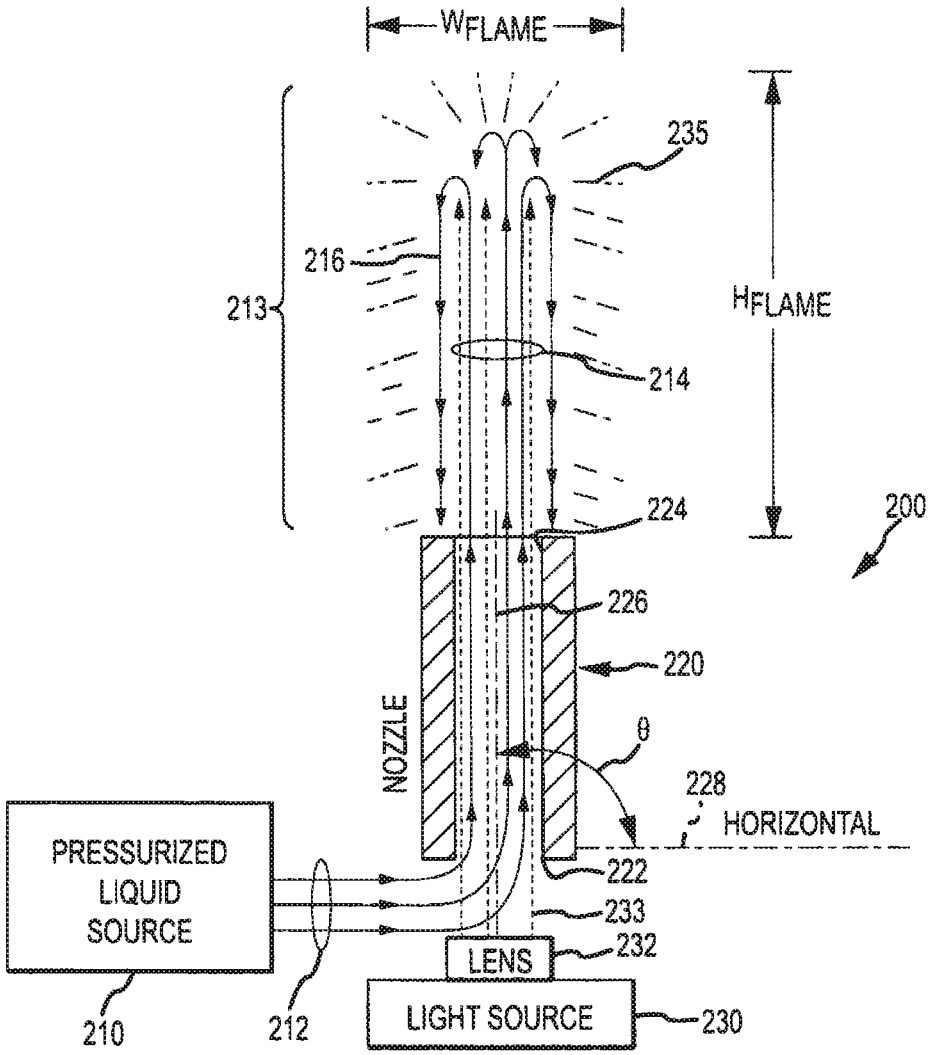
FIG. 2 illustrates a side functional block or schematic view of a portion of an apparatus of the present description such as that shown in FIG. 1 showing the creation of an illuminated flame element using liquid, such as water, in combination with light that both are ejected or output from a nozzle outlet in an upward direction (e.g., generally vertical direction)

FIG. 2 illustrates a functional block, side sectional view of an assembly 200 for providing an oil lamp lighting effect. The assembly 200, for example, may be used to implement the device 120 of FIG. 1. The assembly 200 includes a pressurized liquid source such as water at 3 to 8 psi to provide up to 2 gallons per minute water flow 212. For example, one prototype fabricated by the inventors utilized a 5 psi water source 210 to provide a flow of about 0.75 to 1.25 gallons per minute of water 212.

The assembly 200 also includes a nozzle 220 with an inlet 222 for receiving the pressurized water flow 212 and an outlet 224 for ejecting the water 212. The nozzle 220 is arranged such that a central axis 226 of the outlet (or of the cylindrical nozzle 220) is generally vertical (e.g., at an angle, θ, of about 90 degrees such as 89 to 91 degrees or the like as measured from a horizontal plane 228. In this way, the ejected water travels upward to provide a vertical column of water 214 with a height, $H_{Flame}$, that defines a height of a faux flame or flame element 213. The height, $H_{Flame}$, may vary to practice the invention, but the inventors determined that the nozzle 220 and water flow 212 may be chosen to achieve a flame element 213 with a height, $H_{Flame}$, of about ⅜ to 1 inches to simulate a Kukui pot candle and many typical oil lamps. The faux flame 213 is also formed of the falling water 214, and this is why it is typically desirable to choose a nozzle outlet angle, θ, of about 90 degrees such that the water 216 falls nearly directly downward adjacent the column 214 such that falling water 216 may also be illuminated (by light source 230 and/or by light in column 214).

To illuminate the flame element 213 as shown with light 235, the assembly 200 includes a light source 230. The light source 230 may take the form of an LED in some cases such as a 3 Watt LED that provides light 233 (e.g., amber, yellow, orange, red, white, or other color or color combination such as an RGB LED that may be dynamically changed or tuned during use of assembly 200). The light 233 may be focused by a lens 232 to provide a light stream about the size and shape of the inlet 222. Significantly, the light source 230 is arranged to output the light 233 into the water stream 212 and also to travel upward into the nozzle 220 such as by projecting the light 233 via lens 232 into nozzle inlet 222. The source 230, hence, projects light up through water 214 being ejected from nozzle outlet 224 with a stream 233 parallel to nozzle outlet axis 226. This causes the rising and falling water 214, 216 of faux flame 213 to be illuminated 235 while any adjacent water (such as a small pool of water in a bowl or pot) is generally not illuminated so as to maintain the flame effect of assembly 200 with limited blow by or spill over of light 233.

Figure 3:
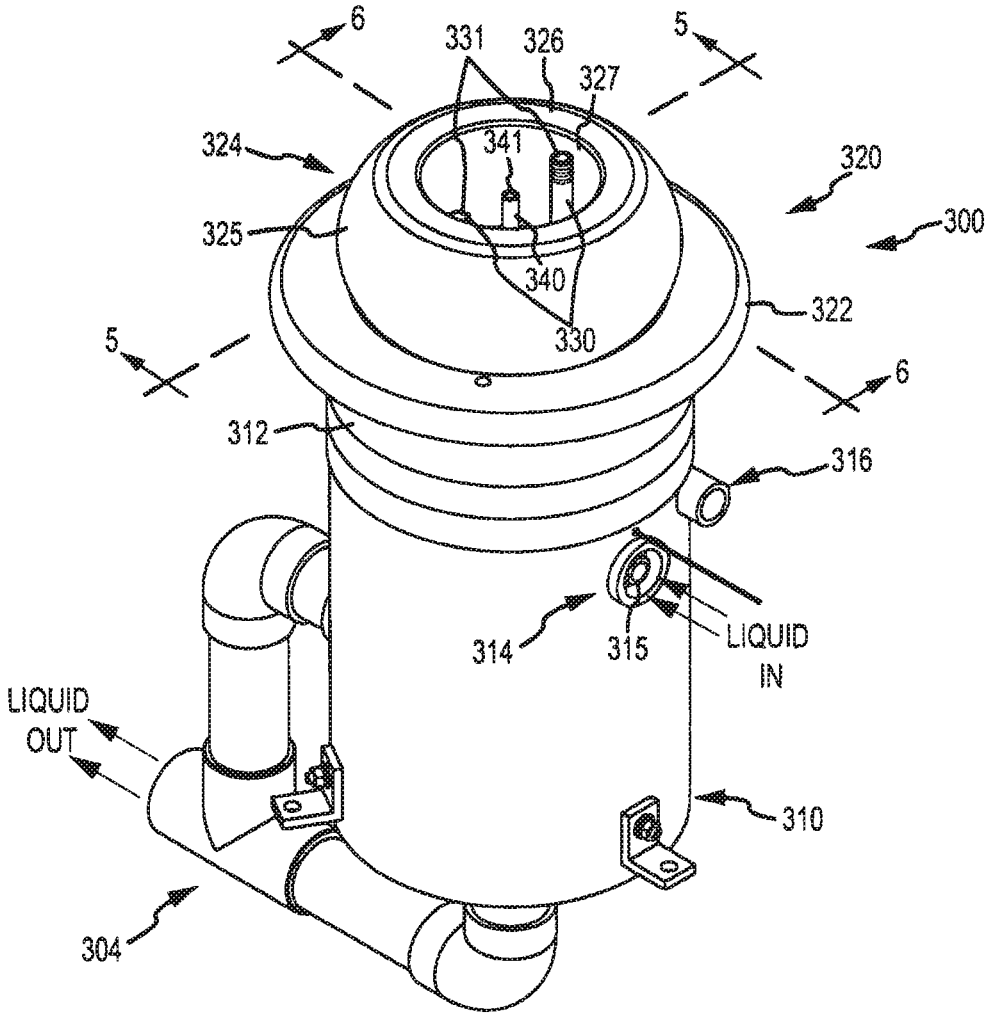
FIG. 3 is a top perspective view of an embodiment of an oil lamp simulator or apparatus for providing an oil lamp lighting effect prior to installation (e.g., before connection to water supply, water drain lines, and control/power supply)

FIG. 3 illustrates a perspective top view of an illumination effects assembly 300 that may be installed and operated to provide an oil lamp or Kukui pot candle effect. The assembly 300 includes a canister 310 that may take the form of a cylindrical container or drum as shown or other forms useful for containing components of the assembly 300. A drain or return line assembly 304 is mounted to and extends into the canister 310. In use, the return lines 304 are used to receive water or liquid entering the inlets 331 of drain elements 330 and to direct this liquid, $Liquid_{Out}$, to a collection system (not shown but may be returned to the pressurized water source to provide a closed loop). The drain elements 330 extend upward within the basin or recessed surface that is used to retain a volume of liquid such as water in bowl or pot 324 during operation of the assembly 300. The location or height of the drain/return inlets 331 defines the depth of the pool or body of liquid in the bowl or pot 324.

The assembly 300 further includes a liquid inlet 314 with a connector 315 for connecting the liquid inlet 314 to a pressurized water source (not shown in FIG. 3). The assembly 300 includes an access port 316 for allowing power/control lines for the light source and/or for control of one or more control valves for the water supply lines to be fed into the interior of the canister 310.

At an upper end 312 of the canister 310, the assembly 300 includes a bowl assembly 320. The bowl assembly 320 includes a base 322 that is mounted to the upper end 312 of the canister 310 and supports the bowl 324. The base 322 has holes or passages for allowing the drain/return elements 330 to extend into the canister 310 for connection to the drain lines 304 and also for allowing the nozzle 340 to be connected to the water and light supply lines/devices in the canister 310.

The bowl 324 includes a sidewall 325 extending in a circle (in this non-limiting example) to define with an inner surface 327 a basin or receiving surface for liquid. This basin is defined in part by the upper edge or rim 326 of the sidewall 325, which defines the maximum depth of liquid that may be retained in the bowl 324. The basin defined by surface 327 may be cylindrical as shown or a portion of a sphere (as found in many bowls with inner surface 327 that extends upward and outward from a central axis).

As discussed above, water or other liquid is removed from the bowl 324 via return or drain elements 330 that may take the form of cylindrical tubes or pipe segments as shown that typically will extend vertically upward to a height below the edge or rim 326. One or more such drain elements 330 may be utilized with two being shown as one useful arrangement. The assembly 300 further includes the nozzle 340 that may also take the form of a cylindrical section of tubing or pipe that is arranged vertically to extend upward within the bowl 324. The outlet 341 is "aimed" upward to eject water or other liquid straight upward, and the outlet 341 may be centrally located in the basin of the bowl 324 or it may be positioned off center is some embodiments depending upon the oil lamp that is being simulated with the assembly 300.

Figure 4A:
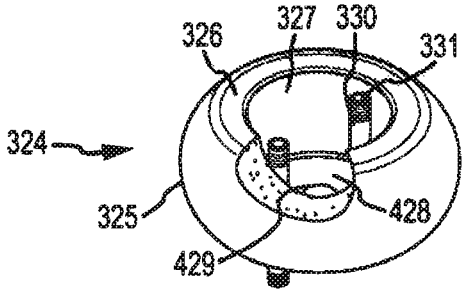
FIGS. 4A and 4B illustrate, respectively, a partial cut away top view and a bottom view of the bowl or pot portion of the apparatus of FIG. 3.
Figure 4B:
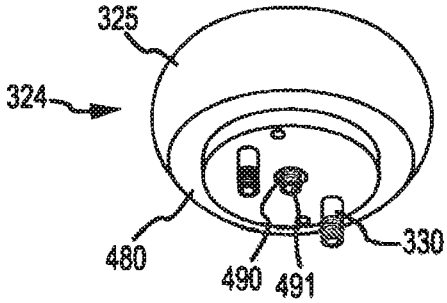

FIGS. 4A and 4B show the bowl 324 in further detail. The bowl 324 may be formed with sidewalls 335 formed of a ceramic or other material (such as plastic, glass, or metal). The drain elements 330 may be fabricated as an integral portion of the bowl or pot 324 or inserted afterwards, and, as shown, the drain elements 330 may extend out of the bottom 480 of the bowl 324 to facilitate connection with drain lines (e.g., lines 304 via tubing or piping in canister 310). The inner surface 327 of the sidewall 325 may have a sloped or planar base 428 and a nozzle connector or adapter 429 may be provided in this base 428 to facilitate later mounting of the nozzle 340. Further, a connector 490 may be provided on the bottom 480 of the bowl 324 to allow the water supply line(s) to be plumbed to the bowl 324 and nozzle 340 (e.g., the tee or cross may be threaded to the connector 490 to provide a water tight connection at the nozzle inlet).

Figure 5:
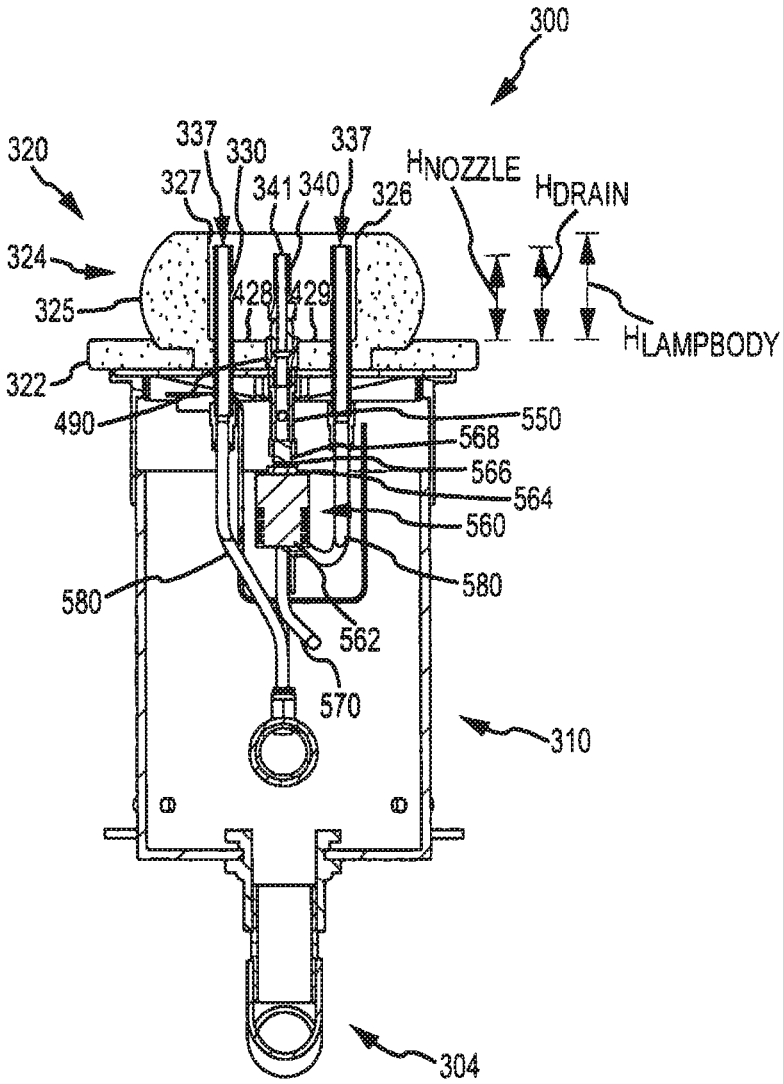
FIG. 5 is a sectional side view of the apparatus of FIG. 3 taken at line 5-5.

FIG. 5 illustrates a sectional side view of the assembly 300 that is useful for showing the arrangement of the drain elements 330 and nozzle 340 as well as components positioned within canister 310. As shown, the lamp body or sidewall 325 and its interior surfaces 327 and 428 provide a basin or pool with a depth (shown as $H_{Lamp\ Body}$), and this is the maximum depth of liquid such as water that can be stored in the bowl 324 prior to it spilling over the edge or rim 326. The inlets 331 of the two spaced apart drain or return elements 330 is at a height, $H_{Drain}$, that is the same or as shown a distance below the edge or rim 326 (e.g., $H_{Drain}<H_{Lamp\ Body}$). In one embodiment, the depth of the pool or basin is about 2 to 4 inches (such as about 3 inches) while the height, $H_{Drain}$, of the drain inlets 331 is 0.1 to 1 inches less (e.g., about 2.75 inches when the depth of the pool is 3 inches). This recessed positioning of the inlets 331 better conceals the presence of the drain elements 330 in the pool of liquid in the bowl or pot 324. In use, water fills the bowl 324 and as it rises above the drain inlets 331 it is drained by gravity from the bowl 324, which is desirable to simulate an oil lamp or candle in which liquid fuel would not be rising and flowing out of a bowl 324.

Further, as shown, the nozzle 340 has a cylindrical inner channel extending along a central axis of its body to the outlet 341. The channel is arranged to be substantially vertical (or its central axis is orthogonal to the horizontal base 428 of the bowl 324). Significantly, the nozzle 340 extends upward from this base 428 to define a nozzle height, $H_{nozzle}$, which is selected in the shown embodiment to be less than the drain element height, $H_{Drain}$. For example, it may be 0.1 to 0.5 inches less in height depending on the pressure of the water/liquid supply and the flame effect that is being achieved with assembly 300. Hence, the ejected water may travel through 0.1 to 0.5 inches of water prior to bursting through the pool or water surface.

In this manner, the water/liquid ejected from the nozzle outlet 341 must travel through a thickness of water/liquid in the bowl pool prior to spraying upward from the pool surface.

Some embodiments may place the inlets 331 and outlet 341 at the same height, but the inventors have proven with prototypes that the lower height, $H_{Nozzle}$, is desirable in many cases to achieve a faux flame or flame element that, when illuminated via the nozzle channel and outlet 341, is truer in appearance, size, and shape to a true or actual oil lamp flame (e.g., provides a surprisingly different artistic effect with assembly 300 when contrasted with a level or even protruding nozzle). In part, this is because the water/liquid does not spray as high as its energy is taken up by the pool/basin water it passes through and seems to disburse from the circular nozzle outlet 341 with a desired width and shape that simulates a flame. Generally, it is useful for the ejected water to create a hump of water and the flame element may not only contain the ejected water but water pushed up by the pressurized water in the pool to form a hump of water (e.g., turbulence or non-laminar flow from nozzle creates desired water flow to achieve useful illumination when light is fired directly up from the nozzle outlet).

As shown, the assembly 300 includes lines 580 that fluidically connect the drain elements 330 with drain lines 304. Also, within the canister 310, the assembly 300 includes pressurized liquid inlet line 570 that connects the pressurized liquid source with the nozzle 340. This connection is via a liquid and light inlet manifold 550 such as a tee or cross that is connected to the inlet line 570, to the inlet to the nozzle 340 via fitting 490 in the bowl 324, and to the light source assembly 560. The manifold 550 is selected to provide a vertical path for the input pressurize liquid up through the nozzle 340 and also to concurrently provide a port for receiving the stream or output light from the light source assembly 560.

To this end as shown in FIG. 5, the light source assembly 560 is plumbed directly into the liquid manifold 550 with plumbing connector or adapter 568. The light source, therefore, is not in the stream of the flowing liquid but, instead, projects upward through the manifold 550 and nozzle 340 and any liquid these contain. The light source assembly 460 includes a light source such as an amber or other colored LED 564. Further, a lens 566 is provided to focus the light from source 564 into the manifold 550 and nozzle 340.

The light source 564 may generate substantial amounts of heat as is the case with many LEDs, and a heat sink 562 may be provided in the assembly 560 to support and remove heat from the LED/source 564 via direct contact. The heat sink 562 typically would be fabricated from a metal and have a body with adequate mass and fins to remove heat at a desired rate. The temperature differential between the LED 564 and the liquid may cause glass or other material of the lens 566 to crack. With this concern in mind, the lens 566 may be fabricated from a heat resistant glass as well as providing the heat sink or LED housing 562 that is designed to better remove heat. The canister 310 is arranged to provide a relatively large volume of air or open space about the fins of the heat sink 562 to allow heat transfer from the fins of the sink/homing 562 to the surrounding air (e.g., such that fans or the like typically are not required for proper operation of the LED/light source 564).

Figure 6:
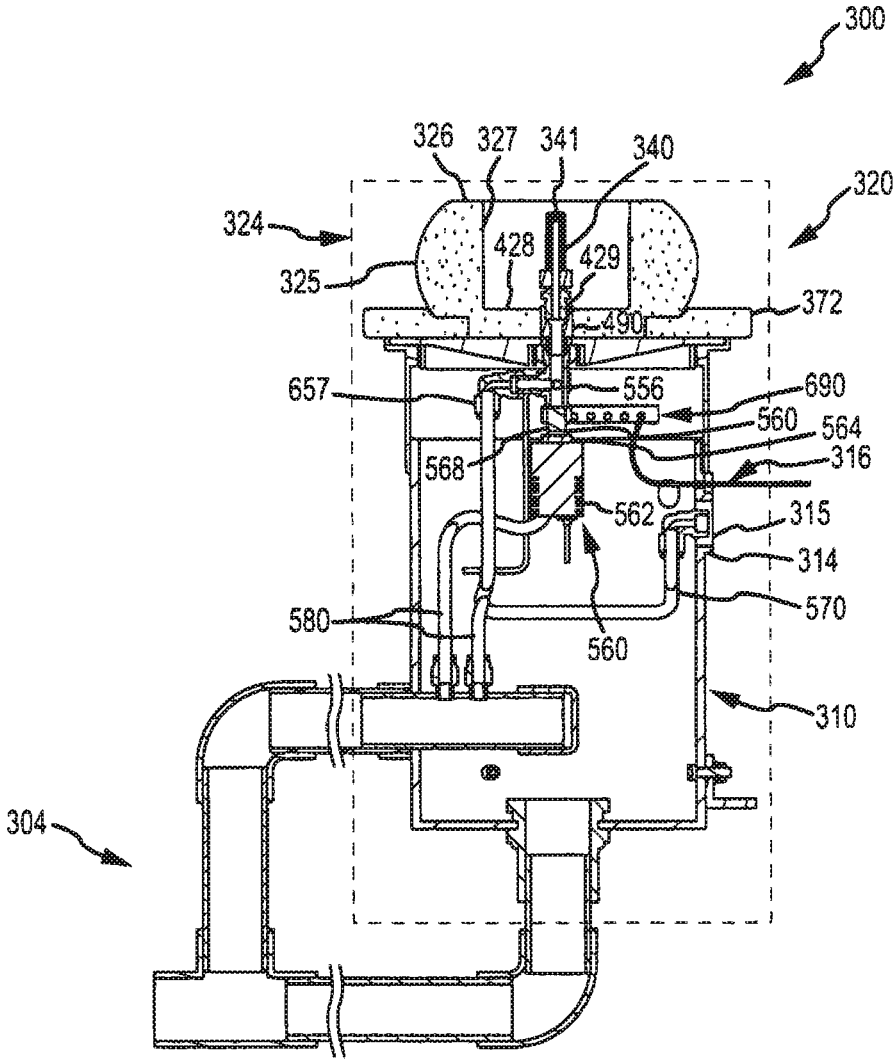
FIG. 6 is a sectional side view of the apparatus of FIG. 3 taken at line 6-6.

FIG. 6 illustrates another cross sectional side view of the assembly 300 with the components of FIG. 3-5 shown in additional detail. Also, FIG. 6 further illustrates the liquid and light input manifold 550, which receives pressurized water via line 570 at inlet fitting or adapter 657. This water is then fed to the body of the tee or other manifold 550 to be discharged via fixture 490 to the nozzle 340 for ejection via outlet 341 into the pool or basin of the bowl 324. The body of the manifold 550 has a channel or fluid passageway through which light is directed upward through by the light source 564 via plumbing fitting or connector 568. FIG. 6 also shows that the assembly 300 may include a control and power assembly 690 that may be used to selectively operate the light source 564. For example, the LED 564 may be operated to change brightness or color to achieve a desired lighting effect during operation of assembly 300.

Figure 7:
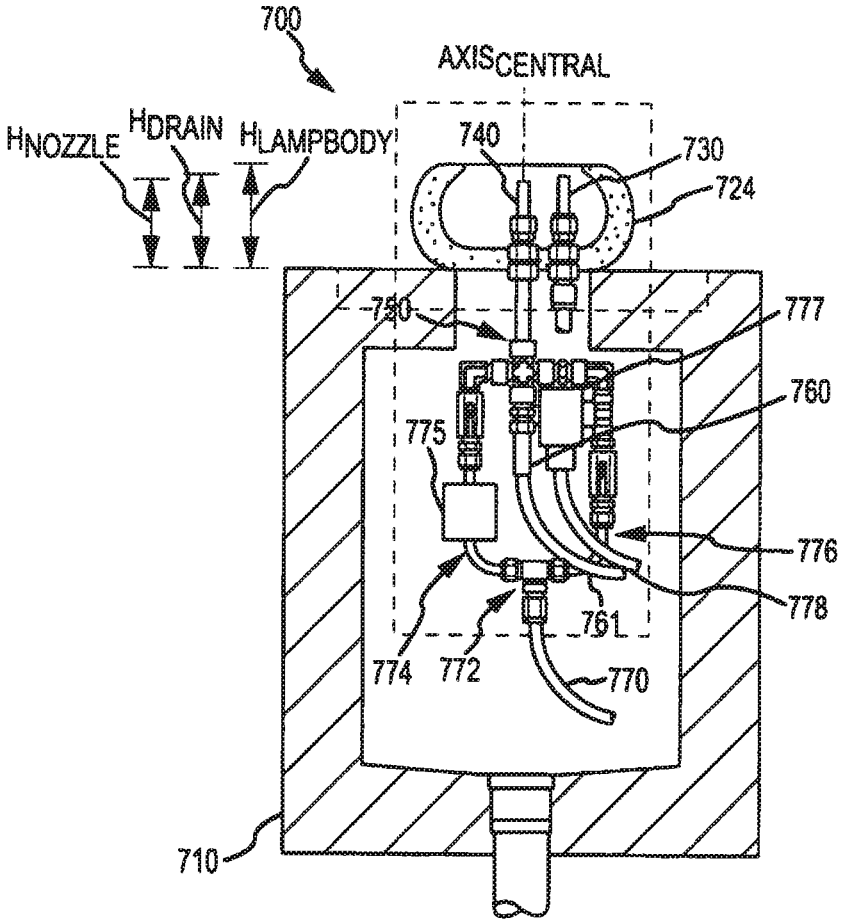
FIG. 7 is a sectional view of another apparatus for providing simulating an oil lamp such as a Kukui pot candle.

In some cases, it may be desirable to vary the size and/or shape of the flame element during operation of a lighting apparatus. For example, the apparatus may be interactive such that an operator/observer may be able to trigger changes in the flame element such as by changing the pressure of liquid entering the nozzle. To this end, FIG. 7 illustrates another embodiment of a lighting apparatus 700 that may be used to provide a flame element with variable flame size and/or shape.

As shown, the apparatus 700 includes a canister or housing 710 upon which a bowl 724 is mounted at an upper end (e.g., over an opening in the canister 710 to provide access from the interior of the bowl 724 to the interior of the canister 710). In the bowl 724, a single overflow 730 is provided that would be piped to drain liquid from the bowl 724 to prevent overflowing of the "fuel source" or "oil." Also, in the bowl 724, a nozzle 740 is positioned to extend upward vertically with its center axis generally orthogonal to horizontal. As shown, the lamp body has a first height, $H_{Lamp\ Body}$, that is greater than the height, $H_{Drain}$, of the inlet of the overflow 730, which in turn is greater than the height, $H_{Nozzle}$, of the outlet of the nozzle 740.

The nozzle 740 is fluidically connected to a liquid and light input manifold 750 (e.g., a plumbing tee or cross). An LED light source 760, which is powered and/or controlled via line 761, is plumbed directly to a port of the manifold 750 to direct its output light vertically upward through the manifold 750 and also through the inner chamber or passageway of the nozzle 740.

Pressurized water is fed into the manifold 750 via a first low pressure line 774 and a second high pressure line 776. To this end, water (or another light transmissive liquid/fluid) at a first pressure (i.e., the high pressure such as 5 to 10 psi or the like) is fed into the canister via line 770 to tee 772, where the pressurized water is branched to first low pressure line 774 and second high pressure line 776 (e.g., 0.25 to 0.5 inch lines or the like with ⅜-inch lines and jet nozzles used in some embodiments of the lighting devices of the present invention). In the low pressure line 774, a regulator 775 is provided to reduce the pressure to a second pressure lower than the first pressure (e.g., a low pressure at 3 to 7 psi or the like). This low pressure liquid is typically provided on an ongoing basis to the manifold 750 for discharge via nozzle 740 to create a "base" faux flame (not shown in FIG. 7 as the apparatus 700 is not shown in an operating state), which may be a flame of 0.375 to 1 inch or the like.

Selectively, this base faux flame will be changed into a larger flame by injecting water from high pressure line 776. This causes the faux flame to increase in size including height in the howl 724. To this end, a solenoid or other control valve 777 may be provided in line 776, and the solenoid valve 777 may be controlled remotely via signals transmitted through control line 778 such as by an operator interacting with the lighting apparatus to selectively change the faux flame.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. As described, the light sources of the oil lamp devices are positioned so as to only illuminate the pressurized water flow and not the water in the pool/basin of the bowl or pot. The nozzles are aligned vertically to have water collapse on itself to get a desired faux element shape and size.

The projection of light upward further provides the flickering flame effect similar to that provided by an actual lamp or candle flame (versus light projected downward that would not illuminate objects above faux flame). In practice, a flickering light is visible directly above the operating oil lamp devices (which mimics conventional candles and lamps). Bowls and pots have been shown herein as being useful, but the concepts are useful for nearly any liquid receptacle having nearly any size, shape, and depth. For example, a larger flame may be useful such as one that is 1 to 6 inches or more in height with a range of widths or a smaller flame may be useful such as to simulate a votive candle or the like (e.g., a flame of less than about 0.375 inches or the like).

We claim:

1. An apparatus for creating an oil lamp lighting effect, comprising:

a receptacle with an inner surface defining a basin for containing a volume of liquid;

a nozzle extending into the receptacle a height above the inner surface;

a liquid input manifold for directing pressurized liquid to an inlet of the nozzle, wherein the nozzle has an outlet ejecting the pressurized liquid received at the nozzle inlet vertically upward;

a light source operable to output light into the liquid input manifold, whereby the output light illuminates the pressurized liquid received at the inlet and ejected out of the nozzle outlet; and a drain line in the receptacle with an inlet at a height above a base of the inner surface for receiving the liquid in the basin having a depth greater than the inlet height, wherein the nozzle outlet is at a height that is less than the height of the inlet such that the pressurized liquid ejected out of the nozzle travels through a portion of the liquid in the basin.

2. The apparatus of claim 1, wherein the pressurized liquid is ejected vertically upward at an angle that is substantially orthogonal to a horizontal plane.

3. The apparatus of claim 1, wherein the inlet height is greater than the nozzle outlet height by at least 0.2 inches.

4. The apparatus of claim 3, wherein the pressurized liquid ejected out of the nozzle outlet travels to a height above the inlet height that is at least about 0.5 inches.

5. The apparatus of claim 1, wherein the light source is connected to a port of the liquid input manifold and directs the output light vertically upward through the liquid input manifold and a fluid passageway of the nozzle.

6. The apparatus of claim 5, wherein the light source comprises a light emitting diode and a heat sink supporting the light emitting diode to conduct heat away from the light emitting diode.

7. The apparatus of claim 6, wherein the light source further comprises a lens between the light emitting diode and the liquid input manifold, the lens fabricated from a heat resistive material and focusing the output light into an inlet of the nozzle.

8. The apparatus of claim 1, wherein the liquid input manifold comprises two inlets for receiving the pressurized liquid, the apparatus further including a low pressure line connected to one of the two inlets providing a first stream of liquid at a first pressure and a high pressure line connected to a different one of the two inlets selectively providing a second stream of liquid at a second pressure greater than the first pressure.

9. A lighting device, comprising:

a pressurized water source providing water at an inlet pressure;

a bowl with a sidewall with an inner surface defining a pool for receiving a volume of water;

a drain element extending upward into the pool of the bowl;

a nozzle extending upward into the pool, the nozzle having an outlet at a first height, the drain element having an inlet at a second height exceeding the first height and being less than a depth of the pool; and a light source outputting a stream of light, wherein the water and stream of light are concurrently directed to an inlet of the nozzle.

10. The lighting device of claim 9, wherein the stream of light is directed vertically upward through the nozzle.

11. The lighting device of claim 10, wherein the outlet of the nozzle is configured such that the water received at the inlet of the nozzle is discharged in a stream that is substantially perpendicular to a surface of the volume of water in the pool.

12. The lighting device of claim 11, wherein the second height exceeds the first height by at least 0.2 inches.

13. The lighting device of claim 12, wherein the discharged stream of water extends upward to a height of at least 0.5 inches above the surface of the water in the pool.

14. The lighting device of claim 9, wherein the light source is an LED and the lighting device further includes an input manifold fluidically connecting the pressurized water source to the nozzle inlet, wherein the LED is connected to the input manifold at one port to transmit the stream of light through the input manifold and the nozzle.

15. An oil lamp simulator, comprising:

a liquid inlet manifold;

a light source operable to output light into a first port of the liquid input manifold;

a second port of the liquid inlet manifold operable to receive a light transmissive liquid at a pressure of at least about 3 psi; and a nozzle fluidically connected to a third port of the liquid inlet manifold for receiving a flow of the light transmissive liquid, wherein the first port and third ports are opposite, whereby the output light travels through the nozzle to be projected out a nozzle outlet with the received flow of the light transmissive liquid.

16. The oil lamp simulator of claim 15, further comprising a liquid receptacle receiving the nozzle such that the nozzle outlet is positioned a first distance apart from an inner surface of the liquid receptacle that defines a pool for holding a volume of the light transmissive liquid.

17. The oil lamp simulator of claim 16, further comprising an overflow line with an inlet a second distance apart from the inner surface, the second distance exceeding the first distance, whereby a depth of the light transmissive liquid in the pool exceeds a height of the nozzle outlet.

18. The oil lamp simulator of claim 15, further comprising a third port of the liquid inlet manifold operable to selectively receive a flow of the light transmissive liquid at a pressure greater than the pressure of the light transmissive liquid provided at the second port.

19. The oil lamp simulator of claim 15, wherein the light transmissive liquid comprises water and the light source comprises an LED and a lens focusing light into the first port.

20. An apparatus for creating an oil lamp lighting effect, comprising:

a receptacle with an inner surface defining a basin for containing a volume of liquid;

a nozzle extending into the receptacle a height above the inner surface;

a liquid input manifold for directing pressurized liquid to an inlet of the nozzle, wherein the nozzle has an outlet ejecting the pressurized liquid received at the nozzle inlet vertically upward; and a light source operable to output light into the liquid input manifold, whereby the output light illuminates the pressurized liquid received at the inlet and ejected out of the nozzle outlet, wherein the light source is connected to a port of the liquid input manifold and directs the output light vertically upward through the liquid input manifold and a fluid passageway of the nozzle.

21. The apparatus of claim 20, wherein the pressurized liquid is ejected vertically upward at an angle that is substantially orthogonal to a horizontal plane.

22. The apparatus of claim 20, wherein the light source comprises a light emitting diode and a heat sink supporting the light emitting diode to conduct heat away from the light emitting diode.

23. The apparatus of claim 22, wherein the light source further comprises a lens between the light emitting diode and the liquid input manifold, the lens fabricated from a heat resistive material and focusing the output light into an inlet of the nozzle.

24. The apparatus of claim 20, wherein the liquid input manifold comprises two inlets for receiving the pressurized liquid, the apparatus further including a low pressure line connected to one of the two inlets providing a first stream of liquid at a first pressure and a high pressure line connected to a different one of the two inlets selectively providing a second stream of liquid at a second pressure greater than the first pressure.

25. An apparatus for creating an oil lamp lighting effect, comprising:

a receptacle with an inner surface defining a basin for containing a volume of liquid;

a nozzle extending into the receptacle a height above the inner surface;

a liquid input manifold for directing pressurized liquid to an inlet of the nozzle, wherein the nozzle has an outlet ejecting the pressurized liquid received at the nozzle inlet vertically upward; and a light source operable to output light into the liquid input manifold, whereby the output light illuminates the pressurized liquid received at the inlet and ejected out of the nozzle outlet, wherein the liquid input manifold comprises two inlets for receiving the pressurized liquid and wherein the apparatus further includes a low pressure line connected to one of the two inlets providing a first stream of liquid at a first pressure and a high pressure line connected to a different one of the two inlets selectively providing a second stream of liquid at a second pressure greater than the first pressure.

26. The apparatus of claim 25, wherein the pressurized liquid is ejected vertically upward at an angle that is substantially orthogonal to a horizontal plane.

27. The apparatus of claim 25, wherein the light source is connected to a port of the liquid input manifold and directs the output light vertically upward through the liquid input manifold and a fluid passageway of the nozzle and wherein the light source comprises a light emitting diode and a heat sink supporting the light emitting diode to conduct heat away from the light emitting diode.

28. The apparatus of claim 27, wherein the light source further comprises a lens between the light emitting diode and the liquid input manifold, the lens fabricated from a heat resistive material and focusing the output light into an inlet of the nozzle.

* * * * *